United States Patent [19]

Harrison

[11] Patent Number: 4,545,436

[45] Date of Patent: Oct. 8, 1985

[54] CENTRALIZER BAND-COLLAR CONNECTION

[75] Inventor: James E. Harrison, Weatherford, Tex.

[73] Assignee: Antelope Oil Tool & Manufacturing Company, Weatherford, Tex.

[21] Appl. No.: 572,558

[22] Filed: Jan. 20, 1984

[51] Int. Cl.[4] ..... E21B 17/10

[52] U.S. Cl. ..... 166/241; 308/4 A

[58] Field of Search ..... 166/241, 172, 170; 308/4 A

[56] References Cited

U.S. PATENT DOCUMENTS

| | | | |
|---|---|---|---|
| 1,282,976 | 10/1918 | Stubbs et al. | 166/241 |
| 2,680,488 | 6/1954 | Atkinson | 166/241 |
| 3,055,432 | 9/1962 | Park | 166/241 |
| 3,282,349 | 11/1966 | Cobbs et al. | 166/241 |
| 4,042,022 | 8/1977 | Wills et al. | 166/241 |
| 4,219,081 | 8/1980 | Howe | 166/241 |
| 4,363,360 | 12/1982 | Richey | 166/241 |

FOREIGN PATENT DOCUMENTS

| | | | |
|---|---|---|---|
| 1156710 | 7/1969 | United Kingdom | 166/241 |
| 1532853 | 11/1978 | United Kingdom | 166/241 |

*Primary Examiner*—James A. Leppink
*Assistant Examiner*—Hoang C. Dang
*Attorney, Agent, or Firm*—Thomas M. Scofield

[57] ABSTRACT

Improvements in well bore centralizers; improvements in centralizers which may be shipped by the manufacturer unassembled, occupying a small volume of space, and later assembled; a field-assemblable casing centralizer consisting of a pair of collars and connecting outwardly bowed leaf springs secured to the collars by a cooperating leaf spring end and collar structure and relief thereof permitting both rivet and weld attachments.

1 Claim, 8 Drawing Figures

CENTRALIZER BAND-COLLAR CONNECTION

BACKGROUND OF THE INVENTION

The subject invention relates to centralizing devices for locating a casing or pipe string concentrically within a well bore or another casing and particularly is directed to a non-weld centralizer which can be packaged in originally disassembled form for space efficient shipping and easily and conveniently finally assembled in the shop or place of business of the purchaser or actually on the job site.

Centralizer devices generally comprise upper and lower collar members having a plurality of outwardly bowed spring members attached at the upper and lower ends thereof in various manners or ways to the collars. Such collars conventionally are constructed of two or more arcuate sections with various means for joining the arcuate section together after being placed around a pipe or casing. The spring members may be welded to the collar sections or mechanically attached thereto by various means and devices.

In use, centralizers are ordinarily supported on a pipe or casing at vertically spaced locations along its length. The outwardly bowed spring members yieldably engage the well bore or another casing circumferential thereto at spaced locations therealong. The well pipe may be a casing disposed within an open well bore or within another casing in the well bore which, when centered, permits a uniform column of cement to be pumped into the annular space between it and the well bore.

When mounted on a pipe or casing section, centralizers are supported for limited endwise movement by one or more stop collars, the latter fixedly clamped or attached about the pipe or casing. A pair of such collars may be attached to the casing above and below the centralizer collars or a single stop collar may be clamped or otherwise attached to the casing intermediate the centralizer collar sleeve ends. Or both. In either case, the stop collars or stop members are so located with respect to the centralizer collars that the latter are freed to move toward and away from one another as the bowed springs expand and contract. This permits the centralizers to function in well bores of somewhat different diameters.

A major factor in the design of many centralizers is the manner in which the bowed spring members are connected or connectible to the end collars of the centralizer. Such connection governs the manner in which the centralizers may be originally assembled at a purchaser's shop, field installation, on the job site, etc. or disassembled for shipping and reassembled away from the point of manufacture. Clearly, a fully assembled centralizer occupies a relatively great volume compared to the volume required for its component elements nested or packed in sets for shipping. In order to minimize the shipping costs of centralizers to distant locations, non-weld centralizers or centralizers that are easily entirely or partially assembleable by the purchaser or in the field have been developed. Many prior such designs have been provided, some of which are noted in the Prior Art section given herebelow. A basic factor with respect to any centralizer construction, however, is that it must be not only structurally sound when assembled, it must also be sufficiently strong that it will function in the well bore environment and not be easily damaged by the rough treatment encountered in well bore use.

Another important factor which is often not sufficiently considered in other centralizer designs or not present or allowed for in other centralizer designs is that the crew at the job site or assembly point may be under job site conditions which preclude sophisticated handling of complexly shaped pieces. Yet further, job site or assembly point personnel may be generally relatively unsophisticated with respect to complex apparatus assembly. Thus, in order to be effective, and useful in its job, a centralizer assembleable away from the point of manufacture or at the job site should be of extremely simple construction and assemblable in a manner that does not heavily tax either the facilities or skills of the job site personnel.

THE PRIOR ART

Applicant is aware of the following patents directed to centralizers, the following list including both key historical centralizer constructions and those centralizer constructions of closest significance to the present invention known to the applicant.

Hall U.S. Pat. No. 2,220,237 "Well Cleaner" issued Nov. 5, 1940;

Hall U.S. Pat. No. 2,258,052 "Spiral Guide and Tubing Holder", issued Oct. 7, 1941;

Hall, Sr. U.S. Pat. No. 2,666,241, issued Jan. 19, 1954 "Band End Connection";

Hall U.S. Pat. No. 2,727,576 "Centralizers", issued Dec. 20, 1955;

Hall, Sr. U.S. Pat. No. 3,177,946 "Casing Guide", issued Apr. 13, 1965;

Dreyfuss U.S. Pat. No. 3,356,147 "Centralizer Device . . . ", issued Dec. 5, 1967;

Laughlin U.S. Pat. No. 3,556,042, issued Jan. 19, 1971 for "Centering Device";

Solum U.S. Pat. No. 3,566,965, issued Mar. 2, 1971 for "Variable Size, Multi-Hinge Centralizer" (particularly see FIGS. 8–10, inclusive);

Kreft, U.S. Pat. No. 4,143,713, issued Mar. 13, 1979 for "Self Centering Basket";

Howe U.S. Pat. No. 4,219,081, issued Aug. 26, 1980 for "Knock-Down Centralizer";

Wilson U.S. Pat. No. 4,269,269, issued May 26, 1981 for "Lock Tab For Centralizer End Ring"; and Richey U.S. Pat. No. 4,363,360, issued Dec. 14, 1982 for "Apparatus For Use . . . ".

BRIEF SUMMARY OF THE INVENTION

The subject device is a centralizer for mounting on a well casing operable to function in the annular space between the casing and well bore or the casing and a concentric second casing. The subject centralizer has a pair of axially spaced collars slideably fittable to the exterior of the casing or pipe on which it is to be mounted. A plurality of outwardly bowed spring members span the space between the collars and are substantially equally spaced circumferentially of the collars. One of the ends of each said bow or spring member is attached to the upper collar, the opposite end to the lower collar.

Each of the centralizer collars has upper and lower edges of lesser internal diameter, thereby to closely fit on and engage the casing with the upper and lower edges thereof. The intermediate portion of each said collar is of greater internal diameter than the upper and lower edges thereof, thus to be spaced outwardly from the casings when the collars are mounted on and engage same. The inboard, adjacent, relatively lesser internal diameter edges of the collars are relieved in a plurality of spaced portions thereof, thus to receive portions of the ends of the spring members thereunder and therepast. A plurality of slots are formed through the collar portions of greater internal diameter, one of said slots being positioned outboard of each of the collar relieved inboard portions.

Each end of each spring member is of substantial U-shape in side view, there being, thus, two U legs (here of shallow configuration) separated by the substantially flat U base. The provision of this spring end construction with the collar inboard edge relief configuration and slots associated therewith enables the ends of the spring members to simultaneously effect engagement of the outermost end of the spring member with the slot and the relieved portion of the collar with the inboard bow curvature with the U-base therebetween underlying the collar greater internal diameter portion also therebetween.

Means are then provided for fixedly engaging the U-base of each bow member with the collar greater internal diameter portion between the slot and collar relieved portion. Such means are, typically and optimally for on job site assembly, rivets.

OBJECTS OF THE INVENTION

A first object of the invention is to provide improvements in basic centralizer design and construction.

Another object of the invention is to provide substantial improvements in non-weld or job site assembleable centralizer constructions where negative assembly point or job site conditions, minimal tooling and training of job site personnel are of minimal importance.

Another object of the invention is to provide a centralizer construction in which the ends of the bowed spring members are connected to the centralizer end collars without required welding or complex fastener construction or, yet, complex structural inter-relationships between the ends of the spring members and the collars.

Another object of the invention is to provide a purchaser or job site assembleable centralizer construction wherein both the collar construction and the configuration and construction of the outwardly bowed spring members, as well as the engagement between the springs and the collars, are of the greatest simplicity, thus to minimize manufacturing costs as well as assembly in the field.

Another object of the invention is to provide such a centralizer construction where the device may be welded in construction if so desired if such facilities are available.

Other and further objects of the invention will appear in the course of the following description thereof.

DRAWINGS

In the drawings, which form a part of the instant specification and are to be read in conjunction therewith, embodiments of the invention are shown and, in the various views, like numerals are employed to indicate like parts.

Figure 1:
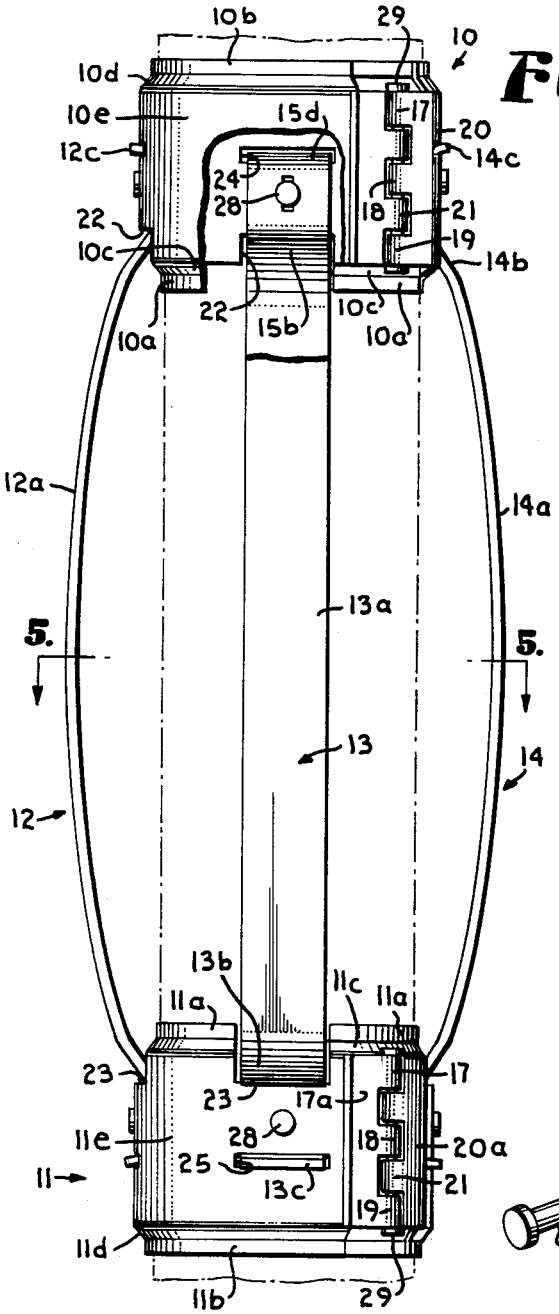
FIG. 1 is a side view of the subject centralizer construction with a portion of the top collar cut away to better illustrate the connection of the ends of the outwardly bowed spring members with the collars.
Figure 2:
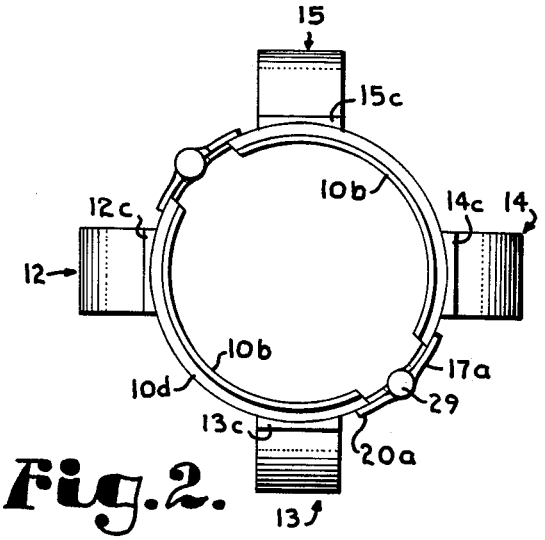
FIG. 2 is a top plan view of the device of FIG. 1.
Figure 3:
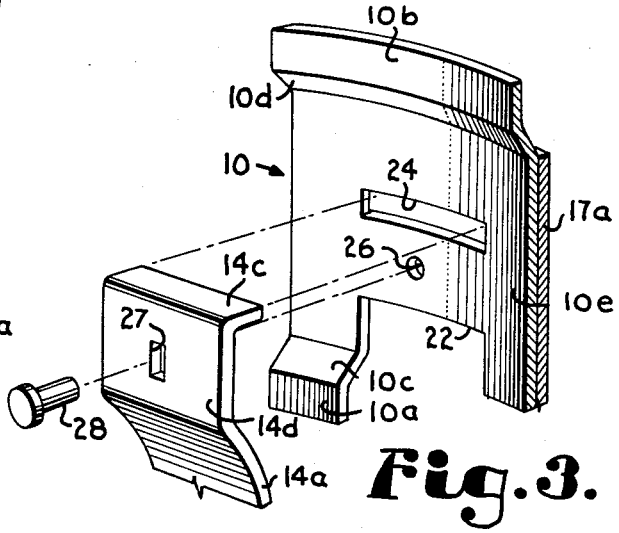

FIG. 3 is an enlarged perspective view of the inside of the upper collar of the device of FIGS. 1 and 2 adjacent a hinge or connection end thereof, the view being both fragmentary and exploded with the upper end of one of the outwardly bowed spring members being shown spaced apart from but in assembly relationship to the collar portion, there also being shown a rivet before insertion into the bow and collar openings provided therefor.

Figure 4:
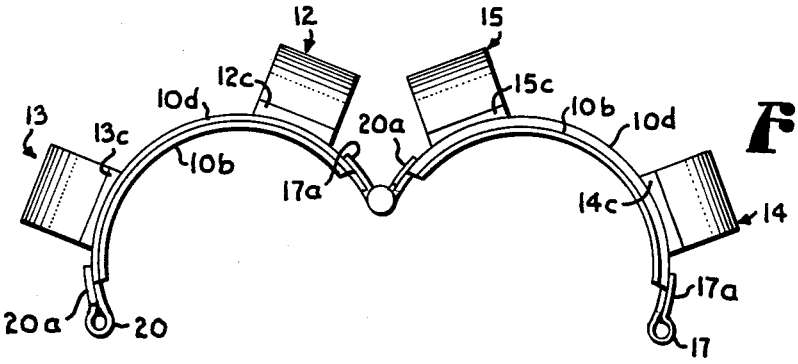

FIG. 4 is a view like that of FIG. 2, but showing the centralizer opened around the hinge thereof before application to a pipe section or a casing.

Figure 5:
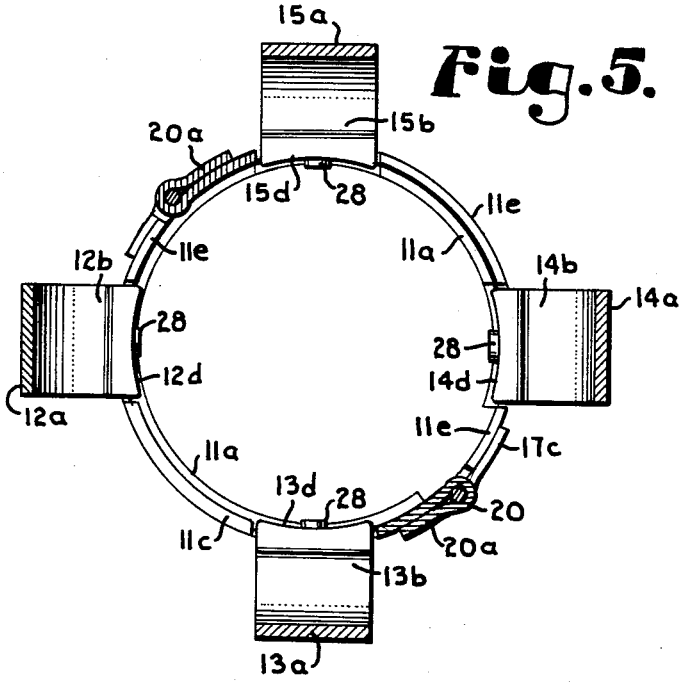

FIG. 5 is a view taken along the line 5—5 of FIG. 1 in the direction of the arrows.

Figure 6:
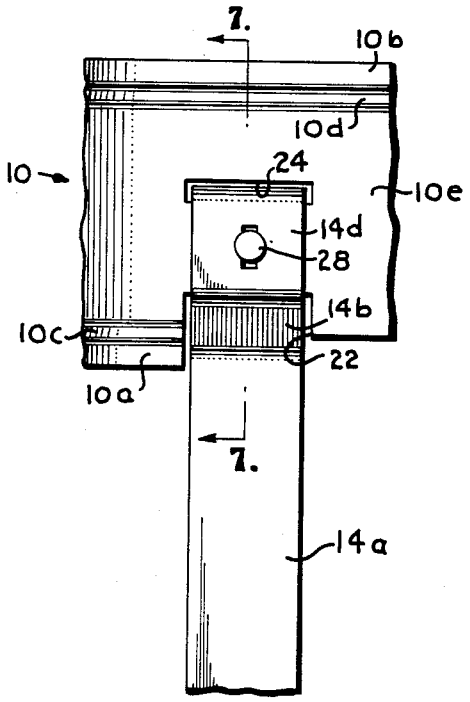

FIG. 6 is an enlarged, fragmentary view of the attachment of the bow 14 with the upper collar 10 taken from the inside of upper collar 10 looking outwardly in the view. This view is analogous to the top center showing of FIG. 1 with respect to bow 13.

Figure 7:
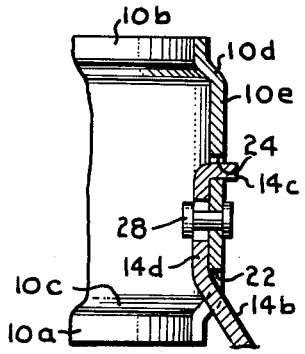

FIG. 7 is a view taken along the line 7—7 of FIG. 6 in the direction of the arrows.

Figure 8:
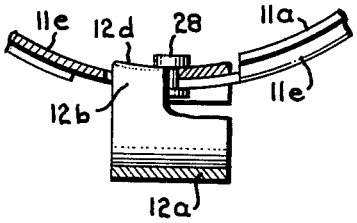

FIG. 8 is a fragmentary view of the lower collar showing the connection of the bow 12 therewith, a portion of the bow cut away to show the construction of the engagement of the bow with the lower collar.

STRUCTURE AND FUNCTION

Referring to the drawings, therein is seen the particular centralizer improvement. First generally characterizing the structure, there are two axially spaced collars generally designated 10 and 11 which are interconnected by (in the specific embodiment shown) four outwardly bowed spring members 12, 13, 14 and 15. The ends of the spring members 12–15, inclusive are, when the centralizer is assembled, as seen in FIGS. 1, 2 and 4, rigidly connected to collars 10 and 11, thus spacing the collars vertically and axially apart as seen in FIG. 1. The detailed structure of the collars will first be described, then the detailed structure of the spring remembers and, finally, their interconnection and integration in the assembled product.

In the subject device, referring first to collars 10 and 11, the two collars 10 and 11 are made up of (each) two identical segments, the two collars being made up of four identical segments. In this manner the segments are interchangeable, one with the other. Accordingly, full description of one segment will describe each other segment, although the segments in the respective collars at each end are inverted with respect to one another so that like edges will be facing like.

In the following description of the collar segments, two sets of numerals will be placed on the segments at the centralizer opposite ends, it being understood that each collar segment is identical and four identical such segments may be joined together to form the upper and lower collars. So proceeding, each said collar has inboard and outboard edges 10*a*, 11*a* (inboard) and 10*b*, 11*b* (outboard) of relatively lesser inner diameter. These ends, flanges or edges are of an internal diameter such that, when the collar segments are closed, as in FIGS. 1 and 2, the collars closely fit around the pipe or casing 16 on which the centralizer is mounted. Immediately inboard of these upper and lower or inner and outer edges 10*a* and 10*b* (or 11*a* and 11*b*) there are provided inwardly flanged portions 10*c* and 10*d* (11*c* and 11*d*) which connect the bearing flanges 10*a*, 10*b*, etc. with the preferably cylindrical greater inner diameter portions 10*e* and 11*e*, respectively. Anticipating the question of relative dimension to come later with respect to the insertion of the free ends of the spring members inside or within a portion of the end collars 10 and 11, it should be noted that the minimum excess internal diameter of the collar body portions 10*e* and 11*e* over that of the bearing flanges 10*a*, 10*b*, 11*a* and 11*b* must be the thickness of the spring members 12–15 inclusive. Preferably, even when (or should) these spring members be welded onto the collars, this additional thickness is required. Where another connecting means is employed, such as the rivets here preferably shown as the connecting means useable for purchaser or job site assembly, then the height or extra clearance of the collar body portions 10*e* and 11*e* over the pipe 16 (seen in dotted lines in FIG. 1) must be, additionally, the height of the rivet head.

The particular centralizer shown in the drawings has four spring members, two to each collar segment employed with the device. With lesser width spring members, or greater diameter collars, three (or even more) spring members could be employed per collar segment or 6, 8, etc. overall. However, when the device is purchaser or job site assembled, it is desired to have the minimum number of spring members to attach to the collars and the minimum number of attachment operations, such as riveting, employed or required. Thus the minimum number of members in this preferred form (and smallest size) here illustrated, specifically four overall or two per 180° arc collar segments.

Now looking at the connection structure of the ends of the collar segment, one end section thereof is initially formed with two elongate rectangular slots therethrough near the end of the collar segment and the end pieces then formed back on one another to provide, on one end thereof the three hinge segments 17, 18 and 19. On the other end of the segment, one center rectangular opening is formed and two edge rectangular pieces removed so that the two segment hinge elements 20 and 21 may be formed, thus to provide, at the opposite ends of each segment, engageable ends for hinge or closure connection engagement with the ends of a like segment. This construction is analogous to that seen in Hall, Sr. U.S. Pat. No. 2,666,241 "Band End Connection", issued Jan. 19, 1954, although that construction shows more hinge elements than are present in this structure. Additionally, preferably, the hinge elements of this structure are formed integrally with the collar metal originally provided.

In the area or zone of the hinges, both the outboard flanges 10*b* and 11*b* and the inboard flanges 10*a* and 11*a* are relieved. However, the outer bearing flanges (or outboard) 10*b* and 11*b* run a solid, lengthy arc from hinge segment to hinge segment above the slots and inboard collar reliefs to be described. On the other hand, the inboard collar bearing portions 10*a* and 11*a* run only between the relieved spring member inserts, in the construction shown, and thus are of considerably lesser area or size.

For clarity in description, the bent back, radially outboard portion of the 17–19 hinge section is labeled 17*a*, while the corresponding portion of the 20–21 hinge section is labeled 20*a*.

Relatively closely adjacent to, but spaced arcuately away from each hinge construction at the end or end edge of each arcuate 180° collar segment, there is provided a relieved, rectangular opening 22 for the upper collar segments 10 and 23 for the lower collar segments 11. As may be seen in FIG. 3, the openings 22 in the upper collar segments 10 relieve the flat collar portion 10*e* on the hinge end sides. However, centrally of each segment, such openings 22 relieve the entire lower flange complex, members 10*a* and 10*c* as well as the central cylindrical portion 10*e*. Immediately outboard (above or below, respectively, for openings 22 and 23 in FIG. 1), there are provided slots 24 in collar segments 10 and 25 in collar segments 11. Where a rivet is to be employed for attachments, as is preferably the case, there is additionally provided an opening 26 (seen in FIG. 3 only) intermediate the opening 22 and slot 24. The same is the case in the collar segments 11 between openings 23 and slots 25. These openings are oversize with respect to the rivet shafts so the rivets will not be sheared by working of the collars and bands in the well bore.

Referring now to the detailed construction of the outwardly bowed spring members 12–15, inclusive, the details of this structure and the engagement thereof with the collar segments are best seen in FIGS. 1 and 3, inclusive. For descriptive purposes, it is assumed that the outwardly bowed member of FIG. 3 is member 14, while those members seen centrally of FIG. 1 are 13 and 15, respectively. The portions of the members 12–15, inclusive which extend between the collars and engage the well bore or outer casing inner surfaces are designated 12*a*–15*a*, inclusive.

The structure of each of the outwardly bowed spring members, particularly as is employed in the specific engagement with the collar segments, will be described specifically with respect to FIG. 3 with equivalent numberings applied to the members 13 and 15 in FIG. 1.

Each end of each spring member is of substantial U-shape in side view with two U legs 14*b* and 14*c* separated by a flat U-base 14*d*. This permits simultaneous engagement of the outermost end or flange 14*c* of member 14 with the slot 24, while the opposite U-leg 14*d* passes through the opening 22. A rivet opening (where rivets are employed for connection) 27 is provided intermediate the U-legs 14*b* and 14*c*. It can be seen that while the U leg 14*c* is at right angles to the U-base 14*d* (which itself is flat), the other, opposite, U-leg 14*b* is arcuately formed with respect to flat base 14*d* or, in the case that it is of flat form, it is angled at about 45° with respect to base 14*d* and then faired into the lesser curvature of the 14*a* portion. It is preferred that the portion 14*b* extend outwardly of openings 22 and 23, intermediate the ends thereof (see FIG. 1, upper and lower left hand side thereof) and then, after collar clearance, fair or bend into the gentler curve of the 12*a*–15*a* portions thereof. Preferably, the outboard face of the portion 14*b* approaches or nearly abuts the upper edge of opening 22 when the rivet 28 attachment is made through openings 27 and 26. Simultaneously, flange 14*c* should be positioned essentially evenly with respect to the upper and lower edges of slot 24 when the connection is made. Openings 27 are preferably slotted as shown so there is no shear or stress on the rivet shaft if the flanges 14*c*, 13*c* top or bottom out on the slots 24, 25 as the centralizer and its elements may be stressed in the wellbore.

In the assembly of the device of the figures, a mandrel must be provided of outer diameter equal to the inner diameter of the flanges, 10*a*, 10*b*, 11*a* and 11*b*. This same mandrel is used for all assembly. It is essentially a pipe or sold mandrel equal in outer diameter to that of the pipe or casing on which the centralizer is to be mounted.

The collars are generally an preferably provided with the segments hinged together by pins 30 wlth the pin 30 free ends welded to hinge elements 19.

The first step in assembly is to take two bows or spring members and place the upset ends in the two slots of one segment. Rivets are implaced through the openings in the bows and collars with the heads of the rivets on the interior of the collar. The operator or worker then rivets the ends of the rivets on the exterior of the collar enough to prevent such from falling out of the collar segment. The other two bows may then be loose riveted on the other collar segment of the hinged pair.

One then places the bow end configuration in the opposite collar segments in like manner with the rivet engagements through the bow end and collar segment openings and rivet heads inboard. Again, the free ends of the rivets extending out through the collar segment openings 26 are riveted enough to hold the opposite segments on the opposite ends of the bows.

At this point, in order to finish the installation of the bows in the collar segments, the centralizer is placed on the round mandrel (consisting of a solid steel round or a piece of pipe as described) with removable pins in the free hinge sections or opposite hinged sections to that originally connected. One then rivets the outside of all eight rivets (four on each collar) to form heads that hold the bows solidly to the collars. At this point, the centralizer may be slid off the mandrel in semi-assembled fashion to await attachment to the casing or the pins removed and the centralizer removed as an open entity as seen in FIG. 4.

In installation of the centralizer on a length of pipe or casing, again, a single stop collar centrally of the device or stop collars above and below the collars (or both) may be employed to locate the device on the pipe or casing in conventional manner.

From the foregoing, it will be seen that this invention is one well adapted to attach all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A centralizer for mounting on a well casing to function in the annular space between the casing and well bore, said centralizer having a pair of axially spaced collars slidably fitted to the exterior of the casing, a plurality of outwardly bowed spring members spanning the space between the collars and substantially equally spaced circumferentially of said collars, one of the ends of each said member attached to the upper collar, the opposite end thereof to the lower collar, each said collar having upper and lower end edges of relatively lesser internal diameter, whereby to closely fit and engage the said casing with the upper and lower end edges thereof, said upper and lower end edges terminating at their uppermost and lowermost extensions in cylindrical, casing embracing portions thereof the intermediate portion of each said collar between said end edges being of greater internal diameter than said upper and lower edges thereof, whereby to be spaced outwardly from said casing when said collars engage same, the inboard, adjacent, relatively lesser internal diameter edges of said collars being relieved in a plurality of spaced portions thereof, whereby to receive portions of the ends of the spring members thereunder and therepast, a plurality of normally horizontal slots formed through the collar portions of relatively greater internal diameter, one said slot positioned outboard of each of the collar relieved inboard portions, each end of each spring member being of substantial U-shape in side view with two U legs separated by a U-base, whereby to simultaneously effect engagement of the outermost end of the member with said slot and the relieved portion of said collar with the inboard member U leg with the U base underlying the collar greater internal diameter portion therebetween, means for fixedly engaging the U base of each member with respect to the collar greater internal diameter portion between the slot and the collar relieved portion, the said spring members being four in number and equally spaced from one another, the said collars each being formed of two 180° arcuate sections, the ends of said sections hinged and latched to one another, the greater internal diameter portion of each collar being substantially cylindrical in form whereby to form a substantially cylindrical boss with respect to upper and lower edges of said collar, the greater internal diameter portions of the collars having an internal clearance with respect to the cylindrical lesser internal diameter upper and lower edges of the collars at least equal to the thickness of the spring members and the height of a rivet head, the means for fixedly engaging the U base of each spring member with a collar greater internal diameter portion comprising a rivet, said rivet having its head positioned radially inwardly of said collar portion and spring end base, there being matching openings through the collar and spring U-base, each of said openings being oversize with respect to the rivet shaft portion extending therethrough, the relieved collar portions on the inboard, adjacent, relatively lesser internal diameter portions thereof also including a relief of a substantial portion of the greater internal diameter collar portions axially next thereto, there being only two collar inboard edge lesser internal diameter portions, such being 180 degrees opposed to one another, as well as being 90° arcuately spaced from the opposed hinge and latch connections and two collar outboard edge lesser internal diameter portions, such also 180 degrees opposed to one another, the said collar inboard edge portions being of considerably lesser arcuate extent than such of the outboard edge portions and such being centered with respect to the said larger outboard edge portions, the slots formed through the collar portions being of greater height than the thickness of the ends of the spring members received therewithin and the means for fixedly engaging the U-base of each spring member with a collar greater internal diameter portion between the collar slot and the collar relieved portion comprising a rivet engaging matching openings therewithin, one such opening positioned within the U-base of the spring member and the other such opening positioned within the collar greater internal diameter portion between the slot and the collar relieved portion therein, the opening in the spring member U-base being slotted axially of the centralizer, whereby working of the spring members with respect to the collars will cause the spring member ends to contact the collar slot edges without shearing the rivets, the collar opening itself oversize.

* * * * *